United States Patent [19]

Sakamaki et al.

[11] Patent Number: 4,648,819

[45] Date of Patent: Mar. 10, 1987

[54] VANE-TYPE ROTARY COMPRESSOR WITH ROTARY SLEEVE

[75] Inventors: Hiroshi Sakamaki, Otsunomiya; Susumu Sugishita, Hanyu; Yukio Horikoshi, Kazo, all of Japan

[73] Assignee: Nippon Piston Ring Co., Ltd., Tokyo, Japan

[21] Appl. No.: 843,841

[22] Filed: Mar. 26, 1986

Related U.S. Application Data

[63] Continuation of Ser. No. 559,812, Dec. 9, 1983, abandoned.

[30] Foreign Application Priority Data

Dec. 11, 1982 [JP] Japan ..... 57-216293

[51] Int. Cl.[4] ..... F04C 18/348

[52] U.S. Cl. ..... 418/173

[58] Field of Search ..... 418/172, 173, 174, 270; 384/109, 114; 308/DIG. 1

[56] References Cited

U.S. PATENT DOCUMENTS

| | | | |
|---|---|---|---|
| 3,647,272 | 3/1972 | Dee | 384/114 |
| 4,120,623 | 10/1978 | Lohn | 418/270 |
| 4,378,195 | 3/1983 | Gamell | 415/90 |
| 4,479,763 | 10/1984 | Sakamaki et al. | 418/173 |

FOREIGN PATENT DOCUMENTS

| | | | |
|---|---|---|---|
| 8000171 | 7/1980 | Netherlands | 384/109 |
| 1023310 | 3/1966 | United Kingdom | 308/DIG. 1 |

OTHER PUBLICATIONS

NASA Tech. Brief, Brief 68-10134, Apr. 1968.

*Primary Examiner*—Leonard E. Smith

*Attorney, Agent, or Firm*—Birch, Stewart, Kolasch & Birch

[57] ABSTRACT

A rotary compressor provided with a rotary sleeve mounted in a center housing for rotation with a plurality of vanes radially slidably fitted in a rotor which is eccentrically disposed in the rotary sleeve, and an air bearing room defined between the outer periphery of the rotary sleeve and the inner periphery of the center housing and internally connected to compressed air in the compressor, characterized in that a multiplicity of air-accumulating grooves are formed in either or both of the outer periphery of the rotary sleeve and the inner periphery of the center housing to increase the bearing capacity of the air-bearing room and prevent the rotary sleeve from directly contacting the inner periphery of the center housing even if the high-pressure in the rotary sleeve pushes aside the rotary sleeve.

6 Claims, 12 Drawing Figures

VANE-TYPE ROTARY COMPRESSOR WITH ROTARY SLEEVE

This application is a continuation of application Ser. No. 559,812 filed on Dec. 9, 1983, now abandoned.

BACKGROUND OF THE INVENTION

1. Field of the Invention

The present invention relates to a rotary compressor that is utilizable as a supercharger for an internal combustion engine and provided with a rotary sleeve mounted in a center housing for rotation with a plurality of vanes radially slidably fitted in a rotor which is eccentrically disposed in the rotary sleeve, and more particularly to an air-bearing room defined between the outer periphery of the rotary sleeve and the inner periphery of the center housing to floatingly support the rotary sleeve.

2. Description of the Prior Art

In Japanese Published Unexamined Patent Application No. 58-65988 published on Apr. 19, 1983, we have shown a rotary compressor provided with a rotary sleeve interposed between a center housing and a rotor and floatingly supported by a compressible fluid. The compressor is particularly suitable for a supercharger with use for an automobile engine required to operate over a wide range of speeds. The rotary sleeve rotates together with the vanes to remove frictional heat as well as frictional wear at the apex of each vane. However, there is the possibility of a scuffing or seizing problem if air is highly compressed in the compression working space confined among the rotary sleeve, the rotor and the adjacent vanes to push the rotary sleeve from within toward the inner periphery of the center housing.

SUMMARY OF THE INVENTION

The primary object of the invention is to provide an improved rotary compressor in which the rotary sleeve is mounted in a center housing for rotation with a plurality of vanes and protected from directly contacting the outer periphery of the center housing when it is pushed aside from within by the high-pressure air in the compression working space.

To accomplish the object as described, the compressor of the present invention having a rotary sleeve mounted in a center housing for rotation with a plurality of vanes radially, slidably fitted in a rotor which is eccentrically disposed in the rotary sleeve, and having suction and discharge chambers, is characterized in that a multiplicity of air-accumulating grooves are formed in either or both of the inner periphery of the center housing and the outer periphery of the rotary sleeve, and the air-bearing room between the inner periphery of the center housing and the outer periphery of the rotary sleeve is supplied with air compressed in the compressor. The air-accumulating grooves are separated from one another and preferably symmetrical with a central cross-section of the air-bearing room. The air-accumulating grooves in the center housing are formed at least in the compression side inner periphery where the rotary sleeve is likely to contact. Air in the air-bearing room is carried along the inner periphery of the center housing by the outer periphery of the rotary sleeve to accumulate at one-side end of each groove, namely, at the counter rotational end of the groove in the outer periphery of the rotary sleeve and the rotational end of the groove in the inner periphery of the center housing. The accumulated air not only increases the bearing capacity of the air-bearing room but also pushes back the rotary sleeve whenever the rotary sleeve is pushed aside by the high-pressure air to press the accumulated air in the grooves.

The advantages offered by the present invention are mainly that the compressor has no scuffing problem even where the air is highly compressed and accordingly the rotary sleeve and the center housing are free from seizure and utilizable for a long period of time.

The other objects and advantages of the invention will become apparent from the following detailed description of the invention in conjunction with the attached drawings.

DESCRIPTION OF THE PREFERRED EMBODIMENTS

Figure 1:
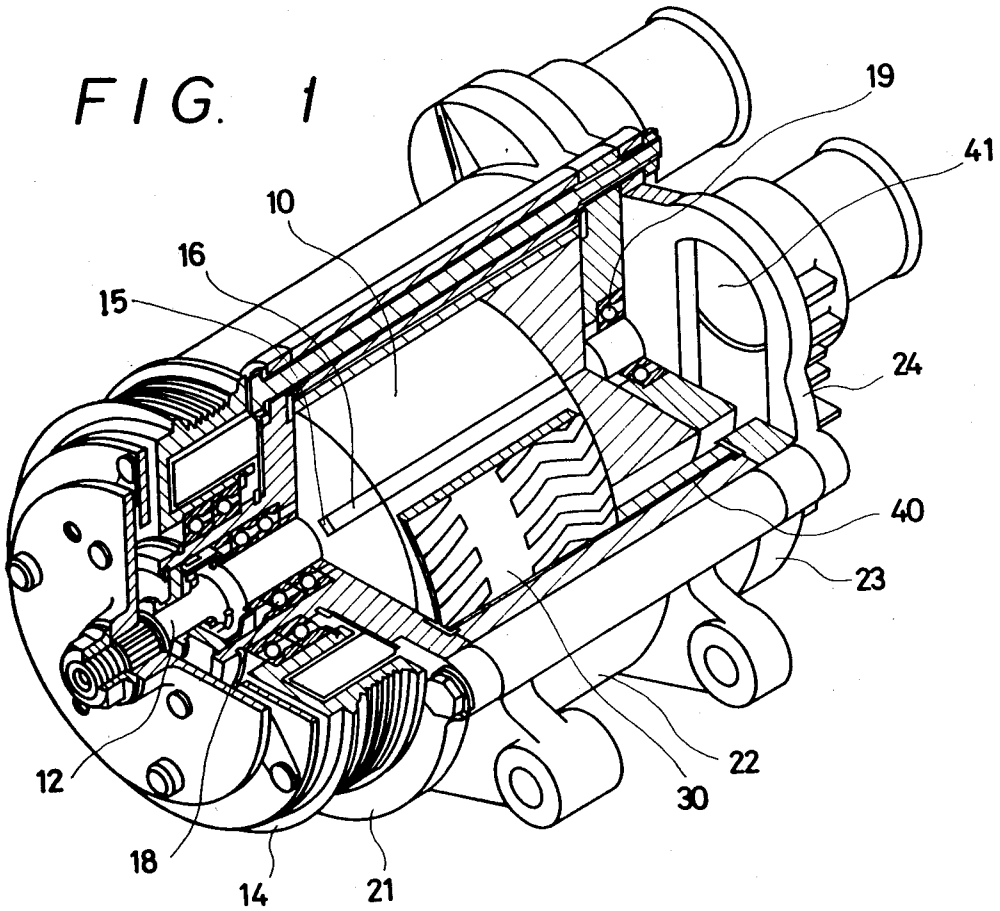
FIG. 1 is a pictorial view of an embodiment of the invention with a part broken away to reveal the inside of the rotary compressor.

The compressor of the invention is described in detail below with reference to the drawings. Referring initially to FIG. 1, the compressor has a rotor 10 integrally provided with a rotary shaft 12, which is rotatably supported by bearings 18, 19 in the respective front and rear side housings 21, 23 and fixed at the front end to a pulley 14 which is rotated by a non-illustrated engine. A plurality of vanes 16 are radially slidably fitted in the respective vane grooves 15 in the rotor 10 and have their apex in contact with the inner periphery of a rotary sleeve 30. The rotary sleeve 30 is mounted within the center housing 22 to define an air-bearing room 40 of 0.02–0.15 mm width therebetween. A gasket is interposed between the rear side housing 23 and the rear cover 24 in which discharge chamber 41 and suction chamber (not shown) are provided.

Figure 2:
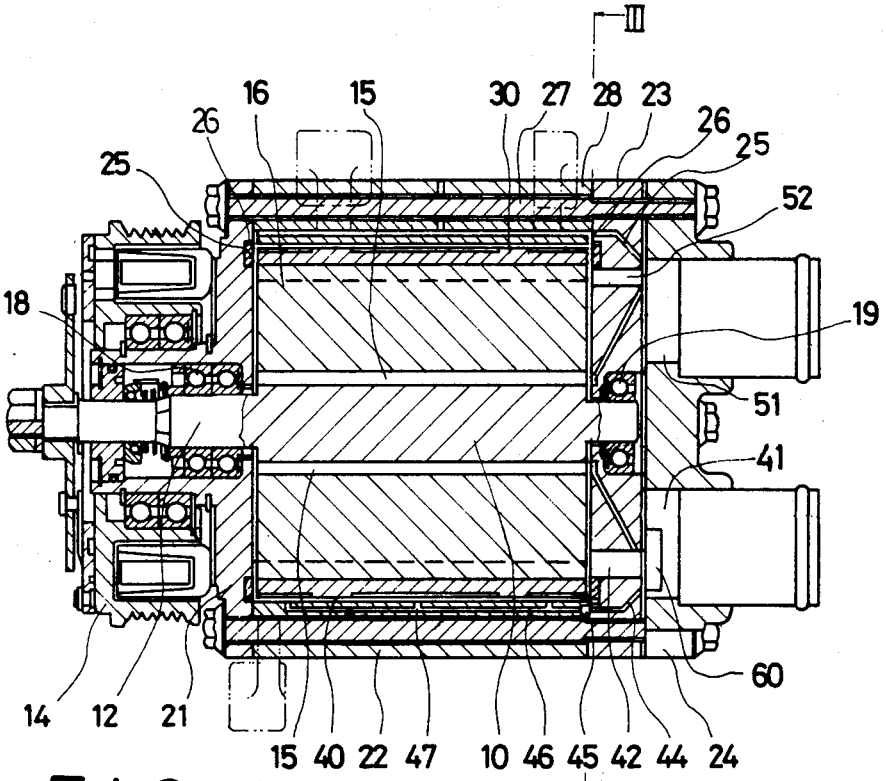
FIG. 2 is an axial section of the compressor of FIG. 1.

As seen in FIG. 2, each vane radially projects from the vane groove 15 in the rotor 10 and has its apex in contact with the inner periphery of the rotary sleeve 30. Front and rear side housings 21, 23 have the respective inner surfaces each formed with an annular groove 26 in which an oilless bearing member 25 is embedded to smoothly contact the side surfaces of the rotary sleeve 30. The discharge and suction chambers 41, 51 are respectively connected to the discharge and suction ports 42, 52. The rear side housing 23 is formed with a high-pressure hole 44 extending from the discharge valve 60 to a high-pressure groove 45 formed in the joining surface between the center housing 22 and the rear side housing 23. The center housing 22 is formed with high-pressure passage 46, which extends axially from the high-pressure groove 45. The high-pressure passage 46 is provided with a plurality of throttles 47 opened to the inner periphery of the center housing 22. Thus, the discharge chamber 41 is connected to the air-bearing room 40. Bolts 27 pass through the thickened wall 28 of the center housing 22, the front and reat side housings 21, 23, and the rear cover 24 to fasten them axially as one body. The ball bearings 18, 19 support the rotary shaft 12, which is removably connected to the pulley 14 with the intervention of an electromagnetic clutch.

Figure 3:
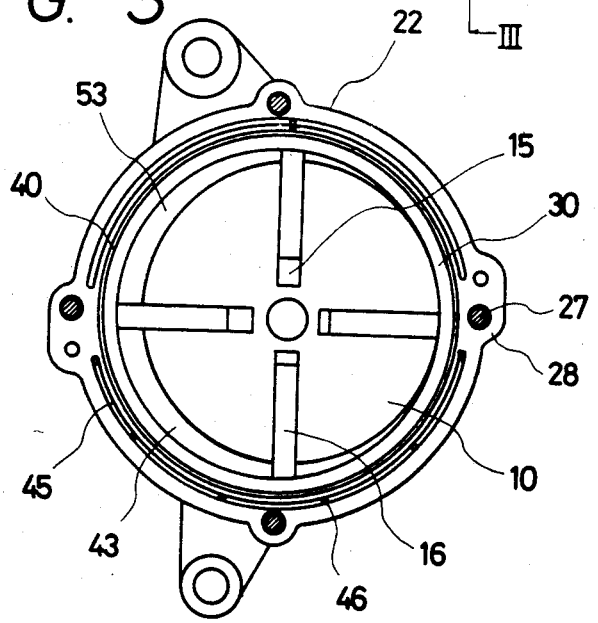
FIG. 3 is a section taken along line III—III of FIG. 2.

As seen in FIG. 3, the high pressure passage 46 are disposed on the high-pressure groove 45 which forms a circular arc of subtended angle of about 170 degrees in the compression side of the compressor. A plurality of high-pressure passages 46 extend axially from the connecting groove 45 into the center housing 22. The air-bearing room 40 is defined between the outer periphery of the rotary sleeve 30 and the inner periphery of the center housing 22 to floatingly support the rotary sleeve 30. Four vanes 16 are fitted in the vane grooves 15 to confine the suction working spaces 53 in the suction side and the compression working spaces 43 in the compression side together with the outer surface of the rotor 10 and the inner surface of the rotary sleeve 30. Four bolts 27 are circularly equidistantly disposed in the thickened wall portions 28 of the center housing 22.

Figure 4:
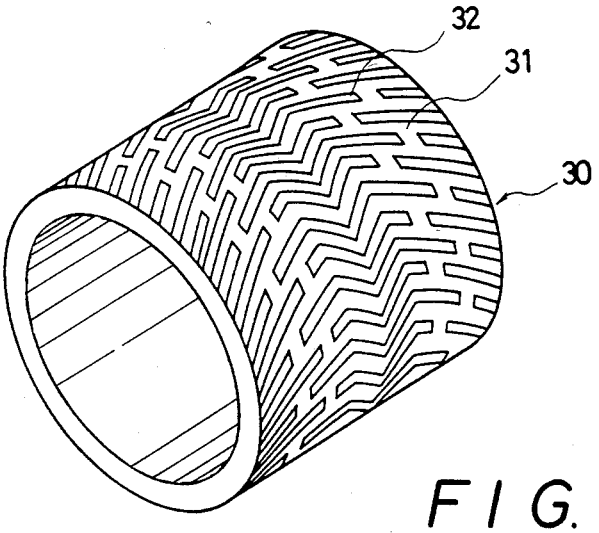
FIGS. 4 and 5 are pictorial and sectional views of the rotary sleeve of FIG. 1, exaggeratedly illustrating the depth of the air-accumulating groove.
Figure 5:
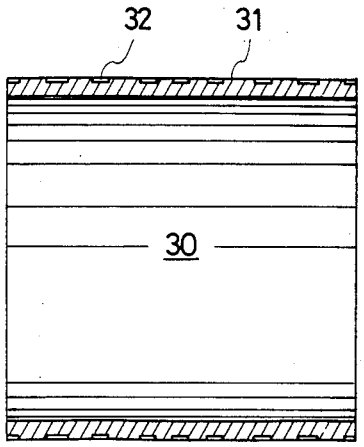
Figure 8:
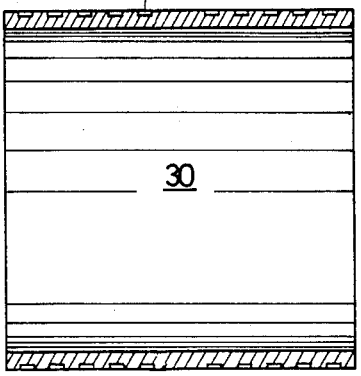
FIGS. 7 and 8 are views of another embodiment, similar to FIGS. 4 and 5.
Figure 6:
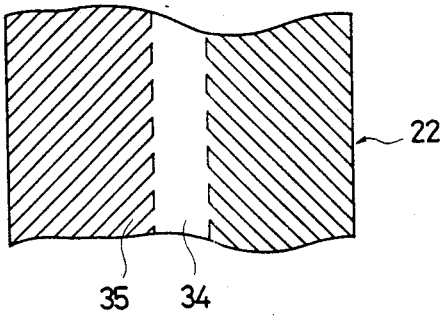
FIG. 6 is a developed view of a part of the inner periphery of the center housing of FIG. 1.
Figure 7:
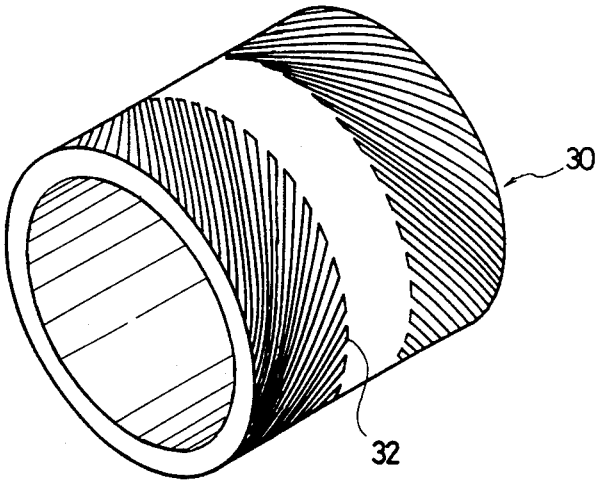
Figure 9:
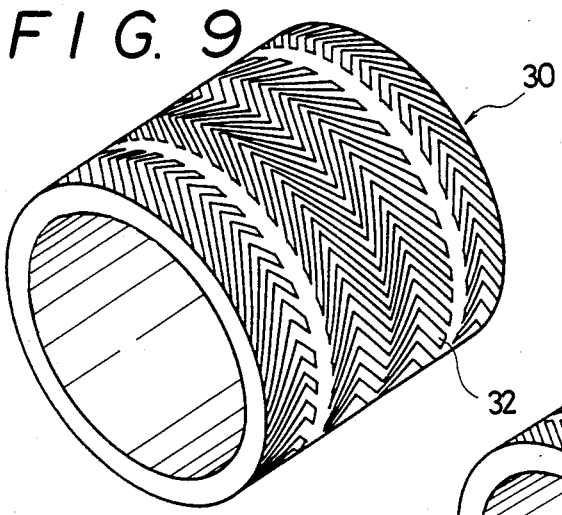
FIGS. 9 to 12 are pictorial views of different embodiments, similar to FIG. 4.

As seen in FIGS. 4 and 5, the rotary sleeve 30 has a multiplicity of herringbone-shaped air-accumulating grooves 32 formed in its outer periphery 31 by electrolytical etching or shot-blast method. The air-accumulating grooves 32 are axially symmetrical and 0.02 mm–0.08 mm deep each having at least one dead end. No air-accumulating grooves are formed both in the inner periphery of the center housing and in the outer periphery of the rotary sleeve. In general, the air-accumulating grooves are provided in the rotary sleeve and those in the center housing are eliminated. In the case that the air-accumulating grooves are provided both in the outer periphery of the rotary sleeve and in the inner periphery of the center housing, it should be avoided that both the grooves fully overlap on one another during the rotation of the rotary sleeve. For example, if the air-accumulating grooves 35 in the inner periphery 34 of the center housing 22 is somewhat V-shaped, as seen in FIG. 6, the rotary sleeve 30 should be formed with inverse V-shaped air-accumulating grooves 32 as seen in FIGS. 7 and 8. Otherwise, the grooves would be of no use in protecting the rotary sleeve against direct contact with the center housing.

Figure 11:
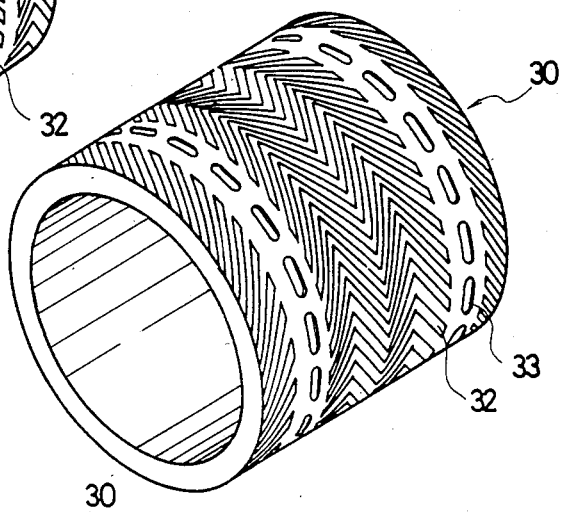
Figure 10:
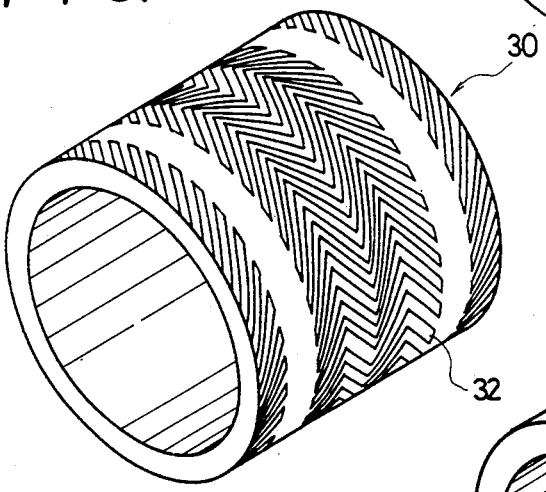
Figure 12:
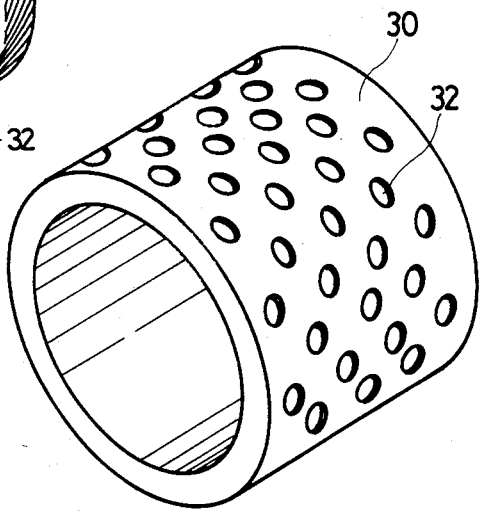

The air-accumulating grooves can be shaped in a variety of forms as seen in FIGS. 9 to 12. The rotary sleeve 30 of FIG. 9 has its air-accumulating grooves 32 composed of a central group of W-shaped grooves and an opposite group of V-shaped grooves. The rotary sleeve 30 of FIG. 10 is provided with the air-accumulating grooves 32 consisting of a central group of W-shaped grooves and an opposite group of slanted grooves which are not symmetrical with respect to each other. The rotary sleeves 30 of FIG. 11 is formed with dimples 33 in addition to the grooves 32 similar to the previous ones. The dimples 33 are peripherally alined or deeper than those having a slanted, V-shaped, and W-shaped configuration. The dimple 33 is somewhat lengthened in the peripheral direction for effective accumulation of air at its counter rotational end as the rotary sleeve 30 rotates. The rotary sleeve 30 of FIG. 12 is formed with air-accumulating grooves 32 in the form of a round dimple that is somewhat different from those in FIG. 11.

In operation, the rotation of engine is transmitted to the rotor 10 by the pulley 14. Air is led into the suctiion working space 53 through suction chamber 51 and suction port 52 and then turned to the compression working space 43. The air is compressed in the compression working space 43 and delivered to discharge chamber 41 through discharge port 42 and discharge valve 60. A part of the compressed air is led through high-pressure hole 44 and high-pressure groove 45 to high-pressure passages 46 from which it injects into the compression side of air-bearing room 40 through throttles 47. The air-flowing along the air-bearing room 40 supports the rotary sleeve 30 with static and dynamic pressure. The injected air is carried by the outer periphery of the rotary sleeve 30 to flow along the inner periphery of the center housing 22. The air is caused to partially accumulate at the respective dead ends in the counter-rotational direction of the peripherally or slantingly lengthened air-accumulating grooves 32, 33 in the outer periphery of the rotary sleeve 30 as well as at the respective end in the rotational direction of the slantingly lengthened air-accumulating grooves 35 in the inner periphery of the center housing 22. The accumulated air increases the air-bearing effect of the air-bearing room 40. It has been tested that the maximum load of the air-bearing room 40 is no more than 30 Kg/sq.cm without the air-accumulating grooves but increases to 150 Kg/sq.cm–200 Kg/sq.cm in the case that either of the center housing and the rotary sleeve is provided with the air-accumulating grooves of the present invention.

The rotary sleeve 30 is pushed aside from within to the compression side, inner periphery of the center housing 22 by the high-pressure air in the compression working space 43 defined among the rotary sleeve 30, the rotor 10, and the vanes 16. However, the accumulated air in the air-accumulating grooves pushes back the rotary sleeve 30 in the inside center of the center housing 22 whenever the high-pressure in the compression working space 43 pushes the rotary sleeve 30 to the inner periphery of the center housing 22. It is effective to prevent the rotary sleeve 30 from contacting the inner periphery of the center housing 22 if either of the inner periphery of the center housing 22 and the outer periphery of the rotary sleeve 30 is formed with the air-accumulating grooves 32, 35. But, it is more effective if the both are formed with the air-accumulating grooves unless both the air-accumulating grooves 32, 35 in the inner periphery of the center housing 22 and the outer periphery of the rotary sleeve 30 overlap one another, thereby dissipating the accumulated air during the rotation of the rotary sleeve 30.

From the foregoing, it will be understood that the air-accumulating groove of the present invention is effective in protecting the outer periphery of the rotary sleeve from directly contacting the inner periphery of the center housing and that there is no possiblity of scuffing and seizing problems between the rotary sleeve and the center housing.

What is claimed is:

1. A rotary compressor provided with a center housing, a rotary sleeve mounted for rotation in said center housing, a rotor eccentrically disposed in said rotary sleeve, said rotor containing a plurality of vanes radially, movably fitted therein, and an air-bearing room defined between the outer periphery of said rotary sleeve and the inner periphery of said center housing, said rotary compressor comprising a multiplicity of air-accumulating grooves formed in both the inner periphery of said center housing and the outer periphery of said rotary sleeve, said grooves not overlapping with respect to one another.

2. The rotary compressor as claimed in claim 1, wherein said air-bearing room is supplied with air compressed in said rotary compressor.

3. The rotary compressor as claimed in claim 1, wherein said air-accumulating grooves are axially symmetrical.

4. The rotary compressor as claimed in claim 1, wherein said air-accumulating grooves are heringbone.

5. The rotary compressor as claimed in claim 1, wherein said air-accumulating grooves are V-shaped.

6. The rotary compressor as claimed in claim 1, wherein said air-accumulating grooves are W-shaped.

* * * * *